United States Patent [19]

Sánchez Giraldez

[11] Patent Number: 4,815,686

[45] Date of Patent: Mar. 28, 1989

[54] HOLDING DEVICE FOR A BELT FOR FITTING TO A BED FRAME

[76] Inventor: José H. Sánchez Giraldez, Am Rathenaupark 3, D-2000 Hamburg 50, Fed. Rep. of Germany

[21] Appl. No.: 886,129

[22] Filed: Jul. 16, 1986

[30] Foreign Application Priority Data

Jul. 22, 1985 [DE] Fed. Rep. of Germany ..... 3526116

[51] Int. Cl.[4] ..... A47B 96/06

[52] U.S. Cl. ..... 248/228; 5/508; 24/72.5; 248/499

[58] Field of Search ..... 248/228, 309.1, 309.2, 248/339, 341, 499; 5/508, 503, 504, 424, 494, 498; 24/2.5, 72.5

[56] References Cited

U.S. PATENT DOCUMENTS

| | | | |
|---|---|---|---|
| 1,044,592 | 11/1912 | Stott | 5/498 X |
| 1,438,475 | 12/1922 | Bisbing | 5/498 |
| 2,605,524 | 8/1952 | Marchese | 24/72.5 |
| 3,313,511 | 4/1967 | Koerner et al. | 5/424 X |
| 4,052,772 | 11/1977 | Tolfsen | 24/182 X |
| 4,297,962 | 11/1981 | Johnson, Jr. | 248/499 X |
| 4,383,343 | 5/1983 | Kulka | 5/508 X |

FOREIGN PATENT DOCUMENTS

| | | | |
|---|---|---|---|
| 321529 | 6/1920 | Fed. Rep. of Germany | 24/265 AL |
| 733980 | 7/1955 | United Kingdom | 5/498 |

*Primary Examiner*—Ramon S. Britts
*Assistant Examiner*—David L. Talbott
*Attorney, Agent, or Firm*—Antonelli, Terry & Wands

[57] ABSTRACT

The invention relates to a holding device for in each case one belt of a safety binding for fitting to a lateral profile rod of a bed frame. A substantially U-shaped holding block, which can be fitted from below on to the profile rod and which is fixable thereto carries a belt ring essentially shaped like a rectangular frame and connected in articulated manner therewith. This can carry a hollow cylindrical sleeve serving as a rotary roll or cylinder for the belt. One leg wall of the U-shaped holding block carries tapped holes for clamping screws for fixing to in each case one lateral profile rod of the bed. The other leg wall is provided with an inwardly open, trough-shaped recess for the pivotable mounting of the belt ring and can be covered by the profile rod of the bed.

8 Claims, 3 Drawing Sheets

Fig. 1
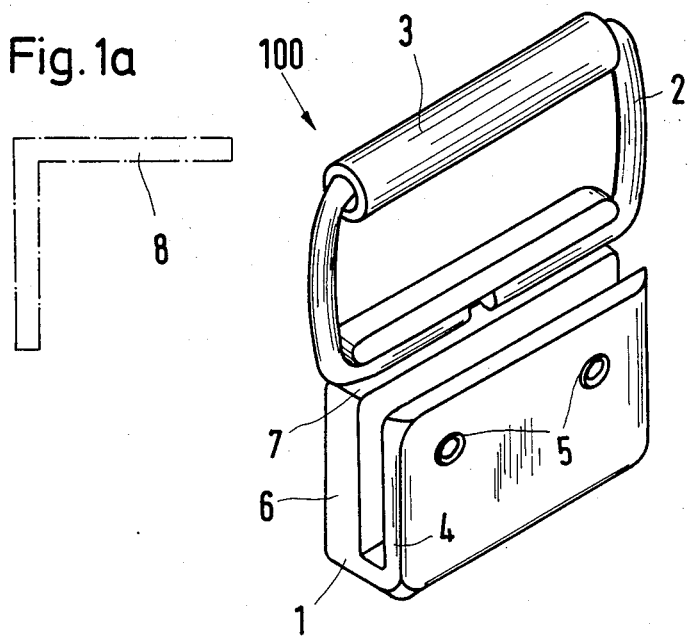
Fig. 1a
Fig. 2
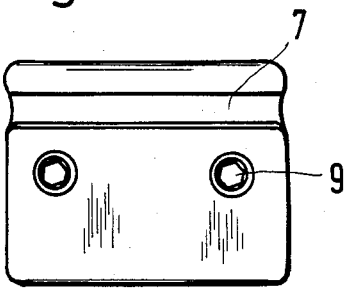
Fig. 3
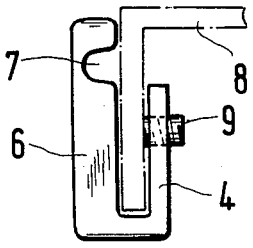
Fig. 4
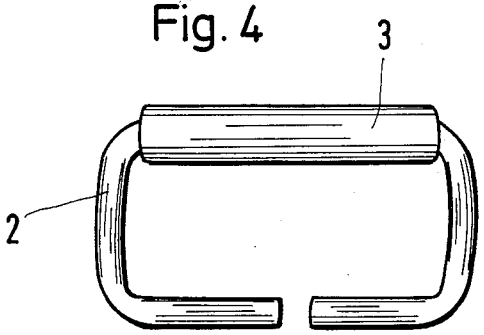

HOLDING DEVICE FOR A BELT FOR FITTING TO A BED FRAME

BACKGROUND OF THE INVENTION

The present invention relates to a holding device for a belt for fitting to a bed frame with lateral rectangular or angular profile rods.

Safety bindings or bands for securing the body of e.g. a restless patient to a bed in such a way that the patient cannot fall out, but still retains a certain freedom of movement, are provided with lateral belt ends serving to fix the safety binding to the bed. It is generally necessary in this connection for the belt ends either to be placed under the bed and joined together or for one of the belt ends to be looped around a lateral rectangular or angular profile rod of the bed frame.

SUMMARY OF THE INVENTION

The problem of the present invention is to provide a relatively simple holding device for a belt to be fitted to only one side of the bed and after the fitting of which the belt can be easily threaded and, if necessary, detached again, e.g. prior to the cleaning of the safety binding. The holding device is to be easily fixable to a lateral rectangular or angular profile rod of a bed frame, whilst also being easily detachable again, e.g. if after prolonged use for a restless patient, the bed is to be used again for another purpose requiring no safety binding.

According to the invention this problem is solved in that the holding device has a substantially U-shaped holding block which can be fitted from below on to the rectangular or angular profile and which can be fixed thereto and a belt ring located on the holding block and essentially having the shape of a rectangular frame.

This greatly simplifies and facilitates the operations necessary for fitting a safety binding to the bed. There is no need to pass the belt ends through the entire width of the bed frame or to raise the mattress and loop in each case one belt end around a lateral profile rod of said bed frame.

One leg of the U-shaped holding block can be provided with tapped holes for receiving clamping screws and the front ends thereof are pressed against one flat side of the profile rod on tightening the screws. The clamping screws are preferably screws which are threaded over their entire length and which can be actuated with a socket wrench.

According to a preferred embodiment, the U-shaped holding block is constructed as a profile body with unequally thick and unequally long leg walls, whereof one thinner and shorter leg wall is provided with the tapped holes and the other, thicker and longer leg wall is provided with an inwardly open, trough-shaped recess, which serves to receive and pivotably mount the belt ring and after fitting on to the rectangular or angular profile rod can be covered by the latter. The belt ring can be formed by a round iron bar bent roughly to the shape of a rectangle. One longitudinal arm of the frame comprising the bent round iron bar and which forms the belt ring can carry a hollow cylindrical sleeve serving as a rotary roll or cylinder for the belt.

According to another preferred embodiment, the U-shaped holding block is constructed as a profile body with unequally thick and unequally long leg walls, whereof the thinner, shorter leg wall is provided with the tapped holes and the other thicker, longer leg wall is provided with a roughly rectangular section for forming the belt ring, said section engaging round a belt guidance opening and has at least in the vicinity of one belt guidance opening longitudinal edge a pitch or part circular or circular cross-section. The section part bounded by the belt guidance opening longitudinal edge can also carry a hollow cylindrical sleeve serving as a rotary cylinder for the belt.

BRIEF DESCRIPTION OF THE DRAWINGS

The invention is described in greater detail hereinafter relative to non-limitative embodiments and the attached drawings, wherein show:

FIG. 1 A holding device according to the invention in a diagrammatic view.

FIG. 1*a* The cross-section through an angular profile rod, to which can be fixed the holding device by fitting on from below and securing by means of clamping screws.

FIG. 2 A plan view from the right of the holding block of the holding device shown in FIG. 1.

FIG. 3 A plan view of the holding block of FIG. 2, viewed from the left.

FIG. 4 The belt ring of a round iron bar bent roughly to the shape of a rectangle with the hollow cylindrical sleeve serving as a rotary cylinder for the belt.

DETAILED DESCRIPTION OF THE PREFERRED EMBODIMENTS

Figure 5:
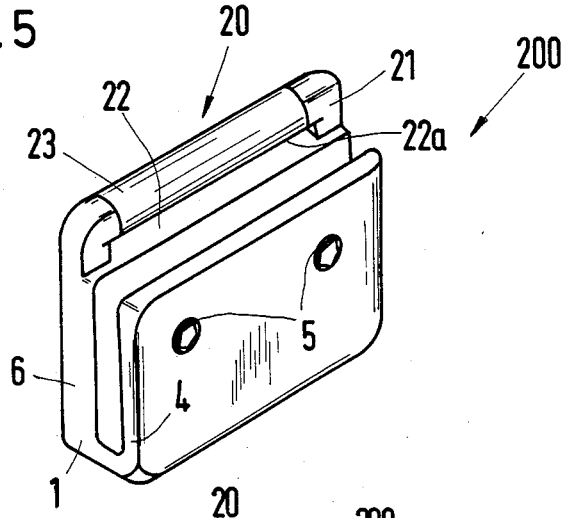
FIG. 5 Another embodiment of the holding device in a diagrammatic view.

The holding device 100 shown in FIG. 1 comprises a substantially U-shaped holding block 1 and a belt ring 2 essentially shaped like a rectangular frame and connected thereto in articulated manner. The belt ring carries a hollow cylindrical sleeve 3 serving as a rotary roll or cylinder for the belt.

The U-shaped holding block 1 shown in FIG. 2 is constructed as a profile body with unequally thick and unequally long leg walls. The thinner, shorter leg wall 4 is provided with tapped holes 5. The other, thicker and longer leg wall 6 has an inwardly open, trough-shaped recess 7, which serves to receive and pivotably mount the belt ring 2 and after fitting on the profile rod 8 shown by dot-dash lines in FIG. 1*a* can be covered by the same, as shown in FIG. 3.

Clamping screws 9 are screwed into the tapped holes 5 of the leg wall 4 of the U-shaped holding block 1. On tightening screws 9, the front ends thereof are pressed against one flat side of profile rod 8. The clamping screws 9 are preferably constituted by screws threaded over their entire length and which are actuated by a socket wrench, which is not shown in the drawings and which on the ends thereof accessible from the outside of the holding block have profile openings, e.g. hexagonal openings, into which fits the socket wrench, so that when the screws are tightened no parts project over the outer surface of leg wall 4. If desired, in order to obtain a particularly firm hold of the device on the profile rod, the screws can be dimensioned and vigorously tightened in such a way that the front ends thereof penetrate the profile rod 8 and deform the same.

Figure 6:
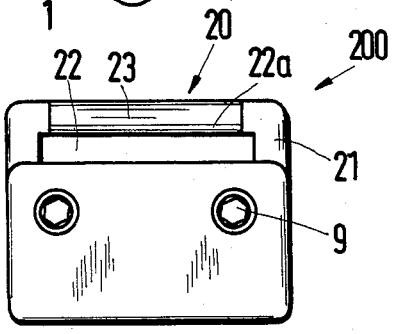
FIG. 6 The holding device according to FIG. 5 in a view from the front.
Figure 7:
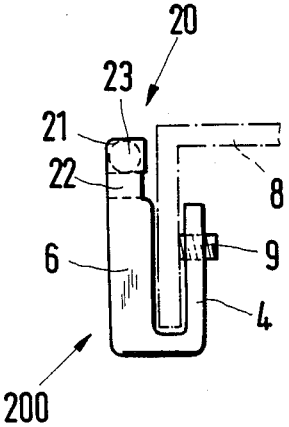
FIG. 7 The holding device according to FIG. 5 in a side view.

FIGS. 5 to 7 show another embodiment of device 200. In this embodiment, the holding device comprises a substantially U-shaped holding block 1 which, as a profile body, is constructed with unequally long and unequally thick leg walls, the thinner, shorter leg wall 4 being provided with tapped holes 5, whilst the thicker, longer leg wall 6, for forming the belt ring 20, has an approximately rectangular, bow-shaped section 21. Section 21 is provided with a belt guidance opening 22 for the passage of the belt. At least in the vicinity of the central portion 23 of section 21, belt ring 20 has a pitch or part circular or circular cross-section, so that friction points with a belt pass through the belt guidance opening 22 during the adjustment thereof are avoided.

Figure 8:
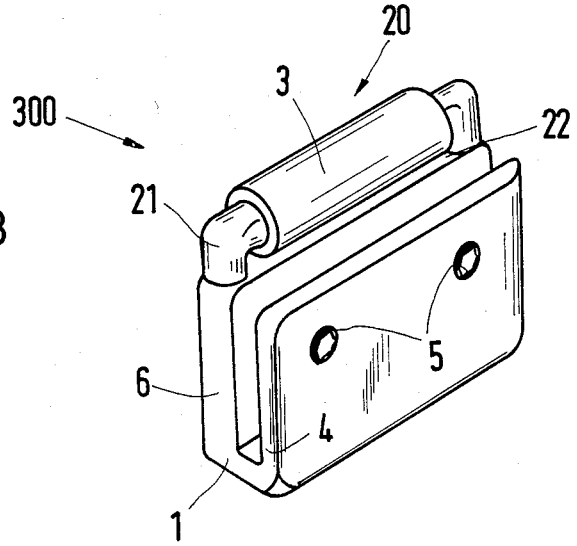
FIG. 8 Another embodiment of the holding device in a diagrammatic view.

Another embodiment of the holding device 300 shown in FIG. 8 carries in the vicinity of the central portion 23 of section 21 a hollow cylindrical sleeve 3 serving as a rotary cylinder or roll for the belt, so that when the belt is passed through the belt guidance opening 22 remains adjustable guided by the belt ring 20.

The invention is not limited to the aforementioned embodiments of the holding device represented in the drawings. The scope of the invention covers different belt ring constructions, as well as a different choice of the means for fixing the holding block to a profile rod.

Figure 9:
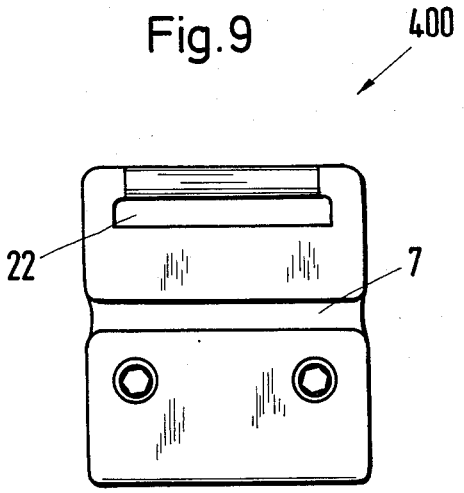
FIG. 9 Another embodiment of the holding device in a front elevational view.
Figure 10:
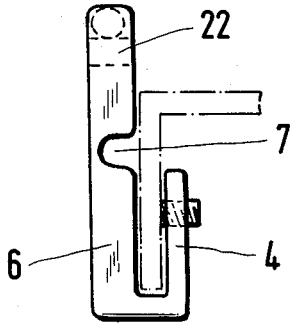
FIG. 10 The holding device according to FIG. 9 in a side view.

Thus, in particular constructions of the novel holding device are conceivable, in which selectively usable possibilities for the passage and securing of a belt are provided. FIGS. 9 and 10 show the holding block of such a construction in two views, from two viewing directions at right angles to one another. In this construction 400, the thicker, longer leg wall 6 is provided both with an inwardly open, trough-shaped recess 7 and also, above the latter, with a belt guidance opening 22 appropriately with an at least partly rounded cross-section of its upper boundary. Such a construction makes it possible either to mount a movable belt ring 2, as shown in FIGS. 1 and 4, in the trough-shaped recess 7 and use same for the passage of a belt, or to pass a belt through the guidance opening 22. In the latter case, the movable belt ring 2 can be omitted. In the case of construction 400, which essentially corresponds to FIGS. 9 and 10, as in FIG. 8 it is possible to provide a roll 3 improving the mobility of the belt on the fixed central portion 23 of the rigid, slot-like ring 22 permitting the passage of a belt. The construction according to FIGS. 9 and 10 consequently permits both a belt mounting with movable ring and a belt mounting with a rigid ring.

What is claimed is:

1. A device for fastening a belt to a bed comprising:

an essentially U-shaped retaining block having a first leg, a second leg, and a connecting wall joining said first and second legs to define a channel between said legs with said first leg extending further from said connecting wall than does said second leg, each of said first and second legs terminating in an edge, said retaining block adapted for attachment to a lateral bar of a bed frame with the lateral bar within the defined channel, with said connecting wall extending horizontally beneath the lateral bar, and with each of said first and second legs extending vertically upwardly on opposite sides of the lateral bar with said leg terminating edges extending horizontally above said connecting wall, said first leg having a trough-shaped, open-faced recess in the surface thereof facing the channel at a position such that when said retaining block is attached to the lateral bar the recess extends parallel with the lateral bar over the entire length of said first leg and above the terminating edge of said second leg, the recess being open and accessible when said retaining block is removed from the lateral bar and being covered by the lateral bar when said retaining block is attached to the lateral bar; and a belt ring having a first portion thereof adapted for reception within the trough-shaped recess when said retaining block is removed from the lateral bar and adapted to be clamped within the recess when said retaining block is attached to the lateral bar, with a second portion of said belt ring then extending horizontally and movable to a position above said first leg upper edge and above the lateral bar to thereby provide a loop for fastening a belt to the bed.

2. A device according to claim 1 wherein:

said second leg has tapped holes therethrough; and said device further comprises clamping screws adapted to threadably engage the tapped holes and extend therethrough to secure said device to the bed frame.

3. A device according to claim 2, wherein each of said clamping screws is threaded over its entire length and has a head portion adapted for operation with a socket wrench.

4. A device according to claim 1 wherein the belt-ring comprises a round iron bar bent roughly to the shape of a rectangle.

5. A holding device according to claim 1, wherein the belt ring carries a hollow cylindrical sleeve serving as a rotary cylinder or roll for the belt.

6. A device according to claim 1 wherein a portion of said belt ring second portion is at least partly circular in cross section.

7. A device according to claim 1 further comprising a belt-strap eyelet portion integral with said retaining block first leg and extending upwardly from said first leg and cooperating therewith to define an eyelet opening for fastening a belt to the bed.

8. A device according to claim 7, wherein the upper section of said belt-strap eyelet portion, at least in the region of the eyelet opening, has at least a partly circular cross section.

* * * * *